US010010742B2

(12) United States Patent
Towley, III

(10) Patent No.: US 10,010,742 B2
(45) Date of Patent: Jul. 3, 2018

(54) SELECTORIZED DUMBBELL WITH A WEIGHT SELECTOR HAVING A CONTINUOUS PERIPHERY THAT ENCLOSES AN OPEN INTERIOR

(71) Applicant: Carl K. Towley, III, Sebastian, FL (US)

(72) Inventor: Carl K. Towley, III, Sebastian, FL (US)

(73) Assignee: PowerBlock Holdings, Inc., Owatonna, MN (US)

( * ) Notice: Subject to any disclaimer, the term of this patent is extended or adjusted under 35 U.S.C. 154(b) by 344 days.

(21) Appl. No.: 15/006,665

(22) Filed: Jan. 26, 2016

(65) Prior Publication Data

US 2017/0209731 A1 Jul. 27, 2017

(51) Int. Cl.

| | |
|---|---|
| ***A63B 21/072*** | (2006.01) |
| ***A63B 21/075*** | (2006.01) |
| ***A63B 21/00*** | (2006.01) |
| ***A63B 23/12*** | (2006.01) |

(52) U.S. Cl.

CPC ..... *A63B 21/075* (2013.01); *A63B 21/00065* (2013.01); *A63B 21/0726* (2013.01); *A63B 21/0728* (2013.01); *A63B 23/12* (2013.01)

(58) Field of Classification Search

CPC ..... A63B 21/06; A63B 21/072–21/075; A63B 21/00065; A63B 23/12

See application file for complete search history.

(56) References Cited

U.S. PATENT DOCUMENTS

| | | | | |
|---|---|---|---|---|
| 5,637,064 | A * | 6/1997 | Olson | A63B 21/0728 482/107 |
| 5,769,762 | A | 6/1998 | Towley, III et al. | |
| 6,872,173 | B2 * | 3/2005 | Krull | A63B 21/0728 482/107 |
| 7,520,845 | B2 * | 4/2009 | Towley, III | A63B 21/0726 482/106 |
| 7,604,577 | B2 * | 10/2009 | Lin | A63B 21/075 482/106 |
| 7,775,947 | B2 | 8/2010 | Towley, III et al. | |

(Continued)

OTHER PUBLICATIONS

WIPO, International Search Report & Written Opinion on Patentability, dated Apr. 20, 2017.

*Primary Examiner* — Gregory Winter
(74) *Attorney, Agent, or Firm* — James W. Miller

(57) ABSTRACT

A selectorized dumbbell has a plurality of nested weights that provide a stack of left weight plates and a stack of right weight plates. A handle is dropped between the stacks and a selector is inserted into one of a plurality of vertically spaced positions on the handle to couple a selected number of the weights to the handle. The selector has a continuous periphery enclosing an open interior. A user who is exercising with the dumbbell will be alerted to unintended dislodgement of the selector since a portion of the selector's periphery will contact a portion of the user's grip hand, wrist or forearm during such dislodgement. This prevents complete dislodgement and prompts the user to restore the selector to a fully installed position. Side walls of the selector may become curved when the selector is installed to provide an additional frictional force resisting dislodgement of the selector.

10 Claims, 5 Drawing Sheets

(56) References Cited

U.S. PATENT DOCUMENTS

| | | | | |
|---|---|---|---|---|
| 7,850,581 | B2 * | 12/2010 | Towley, III | A63B 21/075 482/106 |
| 8,668,630 | B2 * | 3/2014 | Towley | A63B 21/00065 482/104 |
| 2001/0003723 | A1 | 6/2001 | Krull | |
| 2006/0234843 | A1 | 10/2006 | Chen | |
| 2010/0261587 | A1 | 10/2010 | Towley, III | |
| 2012/0264575 | A1 | 10/2012 | Towley, III | |
| 2014/0274596 | A1 | 9/2014 | Krull | |

* cited by examiner

SELECTORIZED DUMBBELL WITH A WEIGHT SELECTOR HAVING A CONTINUOUS PERIPHERY THAT ENCLOSES AN OPEN INTERIOR

TECHNICAL FIELD

This invention relates to exercise equipment and, more particularly, to a selectorized dumbbell having a user selectable exercise mass that is adjustable by selectively varying the position of a weight selector relative to a handle of the dumbbell. This invention further relates to a weight selector that is resistant to being inadvertently dislodged from the handle or incorrectly installed on the handle.

BACKGROUND OF THE INVENTION

U.S. Pat. No. 5,637,064 to Towley et al, which is assigned to the assignee of this invention, discloses an existing selectorized dumbbell that is known as the PowerBlock®. In this dumbbell, there are a plurality of nested weights each of which comprises a left weight plate and a right weight plate that are joined together by a pair of front and rear rails. The left and right weight plates of the nested weights are disposed in nested left and right weight plate stacks that are spaced apart from one another by the length of the front and rear rails. The rails of successive nested weights are longer and lower than the rails of the weight immediately to the inside to allow the weights to be nested together in the aforementioned manner.

The selectorized dumbbell disclosed in the 064 patent includes a handle that is dropped down into the gap between the left and right weight plate stacks. The handle has a pair of planar ends that are spaced apart from one another but are rigidly joined to one another at least by a central hand grip that extends between the ends and is affixed thereto. Each end of the handle includes a vertical array of substantially horizontally extending slots. The various slots in the array are vertically spaced from one another such that one slot is below each of the rails.

A weight selector comprising a U-shaped connecting pin having a pair of spaced, parallel connecting prongs is provided. The prongs of the connecting pin are insertable into the set of slots beneath the rails of a selected one of the nested weights. When the user then lifts the handle, the handle will carry with it the selected weight and all of the nested weights whose rails lie above the rail of the selected weight. Thus, the user can easily adjust the total weight carried by the handle, to adjust the exercise mass of the dumbbell, simply by repositioning the connecting pin from one set of slots to another.

The use of an insertable pin is an effective weight selector for a selectorized dumbbell. However, while it is unlikely to happen, it is possible for a user to incorrectly install the U-shaped connecting pin by inserting one connecting prong on one side of the pin beneath the rails of the selected weight and the other connecting prong on the other side of the pin beneath the rails of the weight either above or below the selected weight. This is called cross-pinning. Since the weights are not correctly held in their most stable configuration when they are cross-pinned, there is a small possibility of damage or failure of the connecting pin and consequent dislodgement of the weights from the handle. This is obviously a disadvantage.

In addition, prior connecting pins of the type described above have incorporated magnets that are magnetically attracted to the rail to which the cross member of the connecting pin is adjacent when the connecting pin is correctly installed in the set of slots beneath the rails of a selected one of the nested weights. This magnetic attraction is designed to be strong enough to form a magnetic latch that holds the connecting pin in place when the user is exercising with the dumbbell. However, the use of magnets increases the manufacturing cost of the connecting pin and increases the danger of disconnection in a cross-pinned situation since the cross member of the connecting pin no longer lies flush against a single rail. In addition, even when the connecting pin is correctly installed and the magnetic latch formed by the magnets is in place, very vigorous exercise in certain instances can very rarely overcome the magnetic attraction to cause the connecting pin to begin to detach from the handle. This is also obviously a disadvantage particularly when the dumbbell is being used in a setting, such as a fitness center or gym, where a particular user may not be intimately familiar with using selectorized dumbbells and correctly installing the connecting pin.

Accordingly, it would be an advance in the art for the weight selector of such a selectorized dumbbell to be designed in a way that would be very difficult for the user to cross-pin and that would have redundant features that would prevent inadvertent dislodgement. This would make selectorized dumbbells more attractive to multi-user exercise facilities, such as commercial fitness centers or gyms, as the proprietors of such facilities would not have to fear that their users would improperly use the dumbbells in ways that could potentially cause the weight selectors to inadvertently disengage during exercise activities.

SUMMARY OF THE INVENTION

One aspect of this invention relates to a selectorized dumbbell which comprises a plurality of nested weights that provide a stack of left weight plates and a stack of right weight plates. A handle is located between the weight plate stacks. A selector is insertable into a selected one of a plurality of vertically spaced positions on the handle to couple a selected number of the weights to the handle. The selector has a substantially continuous periphery substantially enclosing an open interior thereof. During unintended dislodgement of the selector during exercise activities using the dumbbell, a portion of the selector's periphery contacts a portion of a user's hand, wrist or forearm on an arm the user is using to grip the handle to stop further dislodgement of the selector.

Another aspect of this invention relates to a selectorized dumbbell which comprises a plurality of individual weights that can be nested together to provide a left stack of nested left weight plates and a right stack of nested right weight plates that are separated by a gap. A handle is provided having a hand grip extending along an axis with the handle further having opposite left and right ends joined to opposite ends of the hand grip with the left and right ends of the handle extending perpendicularly to the hand grip. The handle may be dropped down into the gap between the stacks of nested left and right weight plates with the left end of the handle being adjacent an innermost left weight plate in the left stack of weight plates and the right end of the handle being adjacent an innermost right weight plate in the right stack of weight plates. A selector is provided having a substantially continuous periphery that substantially encloses an open interior of the selector. The selector is horizontally insertable into the ends of the handle into a selected one of a plurality of different vertical positions on the handle to connect a desired number of weights to the handle depending upon which vertical position receives the selector. The open interior of the selector when the selector is installed overlies or underlies the hand grip of the handle.

Yet another aspect of this invention relates to a selectorized dumbbell which comprises a plurality of individual weights that can be nested together to provide a stack of nested left weight plates and a stack of nested right weight plates that are separated by a gap. A handle is provided that may be dropped down into the gap between the stacks of nested left and right weight plates. A selector is provided that connects a desired number of weights to the handle. The selector comprises at least one elongated connecting member that is insertable into a selected one of a plurality of vertically spaced slots provided on the handle with the number of weights coupled to the handle varying depending upon which slot receives the connecting member. The at least one connecting member has a natural, flat state when it is not installed in the selected slot. Each of the slots has a curved central portion therein. The at least one connecting member includes a flexible central portion that becomes curved by virtue of being received in the curved central portion of the selected slot when the at least one connecting member is installed in the selected slot. The curved flexible central portion of the at least one connecting member develops a biasing force that attempts to restore the at least one connecting member to the natural, flat state thereof with the biasing force serving to frictionally resist disconnection of the at least one connecting member from the selected slot.

BRIEF DESCRIPTION OF THE DRAWINGS

This invention will be described more completely in the following Detailed Description, when taken in conjunction with the following drawings, in which like reference numerals refer to like elements throughout.

DETAILED DESCRIPTION

Figure 1:
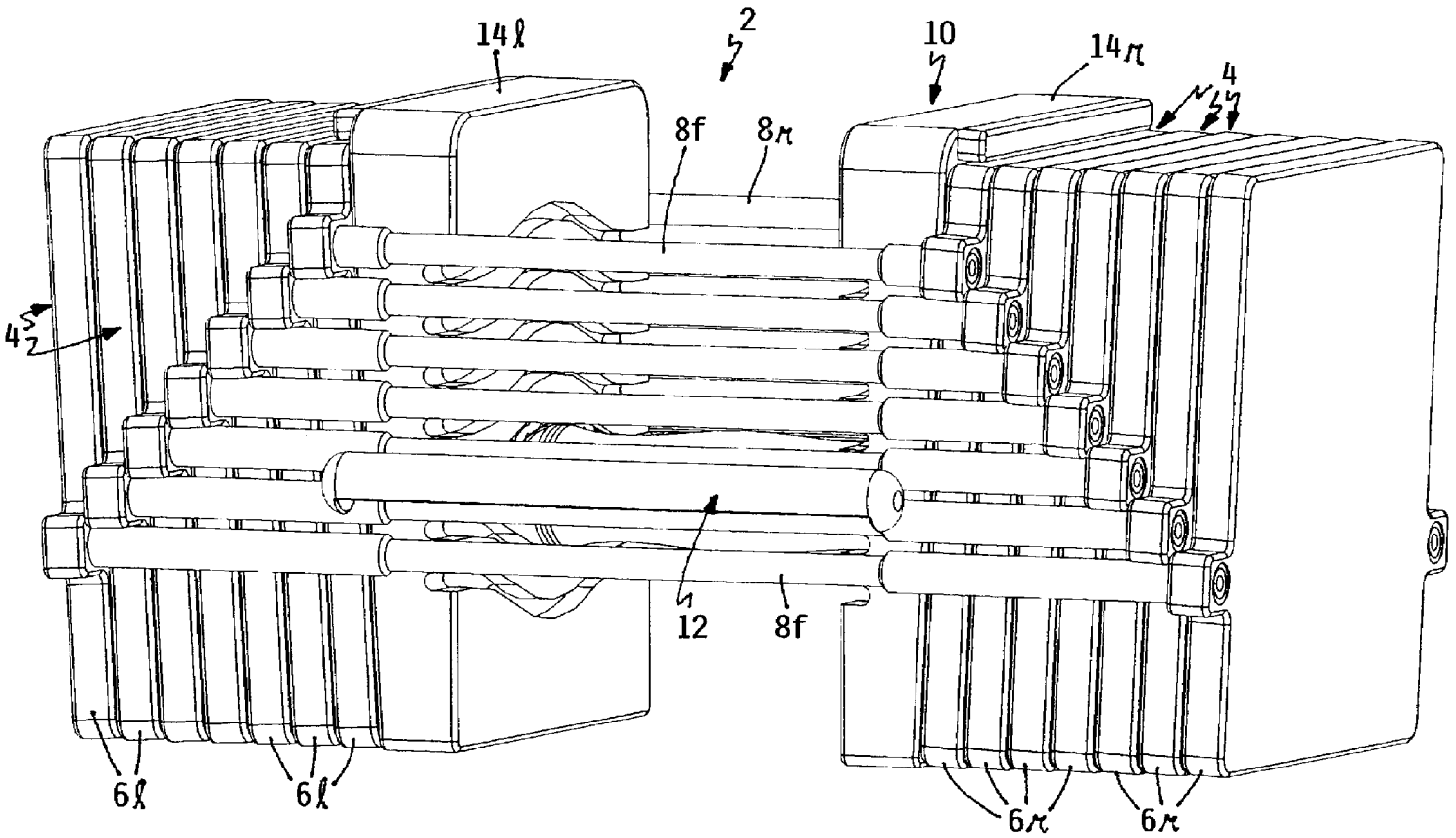
FIG. 1 is a perspective view of one embodiment of selectorized dumbbell according to this invention, particularly illustrating the weight selector in an installed position beneath the rails of the fifth nested weight of the dumbbell such that the five innermost nested weights will be lifted when the user grips the hand grip of the handle and lifts upwardly.

One embodiment of a selectorized dumbbell according to this invention is indicated generally as 2 in FIG. 1. Dumbbell 2 is of the general type disclosed in U.S. Pat. Nos. 5,637,064 and 7,775,947, which are hereby incorporated by reference. See in particular the dumbbell disclosed in FIGS. 6-12 of the 947 patent and the accompanying description thereto. While such patents may be referred to for a complete description of dumbbell 2, a review of the basic components of dumbbell 2 is in order herein.

Referring now to FIG. 1, dumbbell 2 comprises a plurality of nested weights 4, a handle 10, and a weight selector 12. Each nested weight 4 comprises a left weight plate **6*l* and a right weight plate 6*r* that are joined together in a laterally spaced apart orientation by a front rail 8*f* and a rear rail 8*r* that connect weight plates 6*l* and 6*r* together. Beginning with the innermost weight 4 and working outwardly to the outermost weight 4, rails 8 get progressively longer and connect to the weight plates 6 at progressively lower vertical elevations to allow weights 4 to nest together with left weight plates 6*l* being adjacent to one another in a left stack and right weight plates 6*r* being adjacent to one another in a right stack. Thus, front rails 8*f* and rear rails 8*r* are each arranged in a truncated pyramidal shaped array on the front and back sides, respectively, of dumbbell 2**.

Handle 10 has a planar left end **14*l* and a planar right end 14*r* that are joined together in a laterally spaced apart orientation at least by a central hand grip 16. Handle ends 14 may also be joined by cross tubes (not shown) that are parallel to hand grip 16, but such cross tubes may be deleted if so desired or if not needed for strength. Handle 10 is dropped down into the gap formed between the left and right stacks of nested plates 6 in order to couple a desired number of weights 4 to handle 10. When handle 10 is inserted between the left and right stacks of nested weight plates 6, left end 14*l* of handle 10 is adjacent to left weight plate 6*l* of the innermost weight 4 and right end 14*r* of handle 10 is adjacent to right weight plate 6*r* of the innermost weight 4 as shown in FIG. 1**.

Each handle end 14 carries an identical vertical array of slots 20. In each array of slots 20, each slot 20 is aligned with a gap 22 formed between different pairs of vertically adjacent rails 8. Gaps 22 provide access to slots 20 for the reception of a portion of selector 12. See FIGS. 2 and 3.

Figure 5:
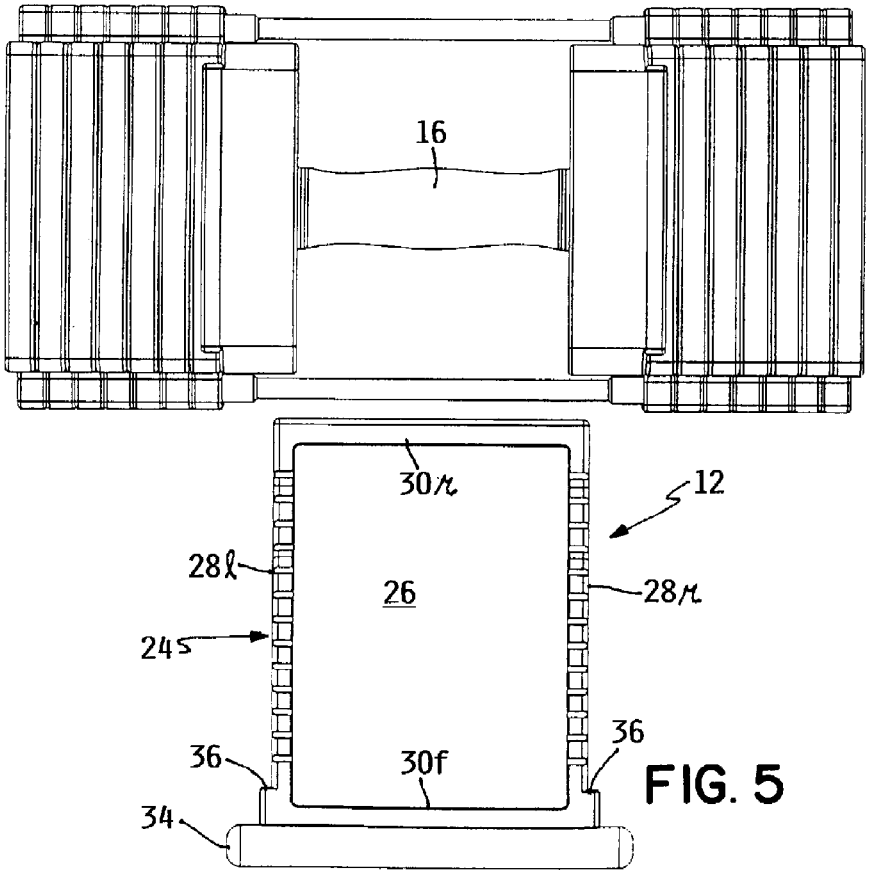
FIG. 5 is a top plan view similar to FIG. 4, particularly illustrating the weight selector in a non-installed position.
Figure 7:
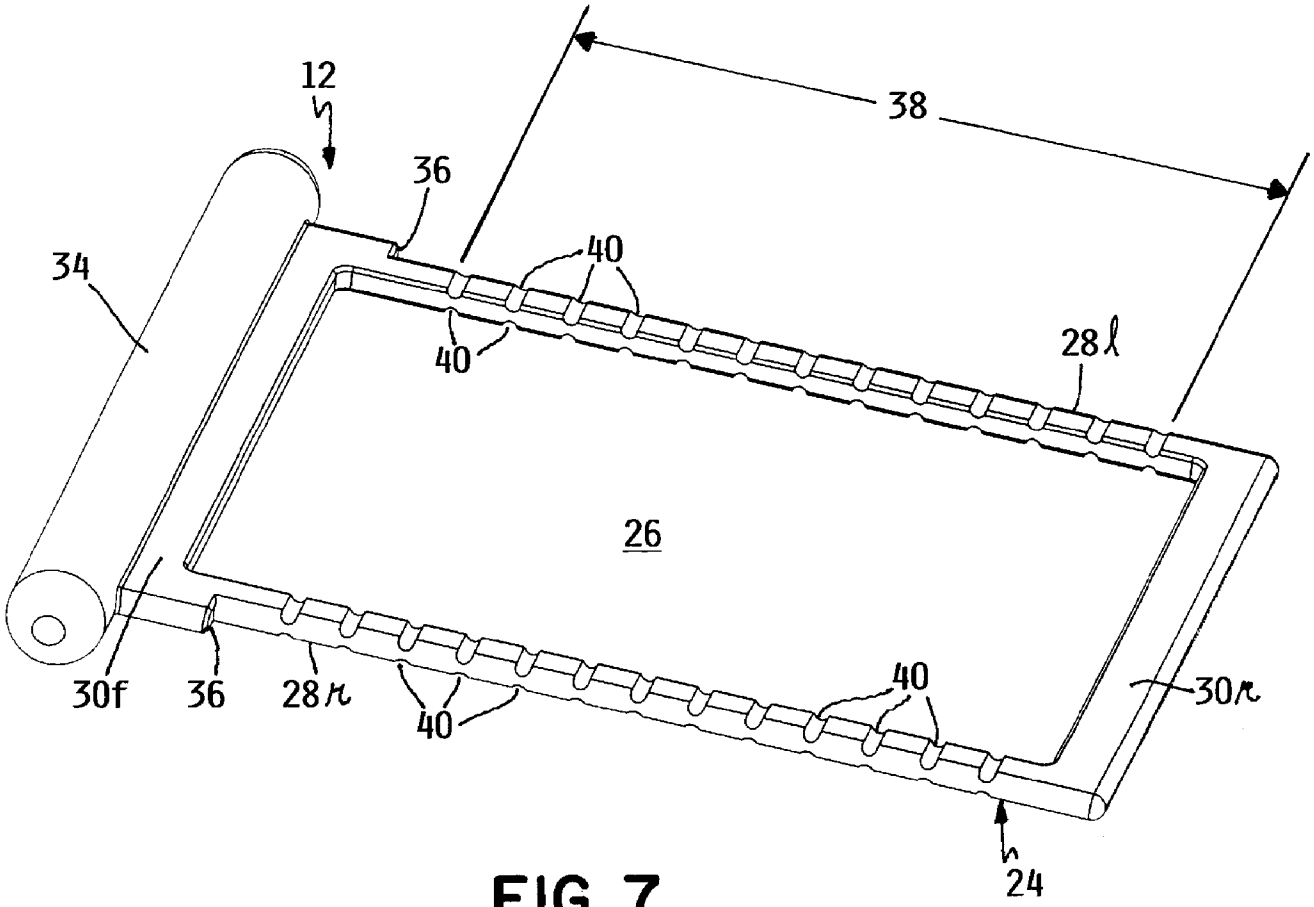
FIG. 7 is a perspective view of the weight selector used in the dumbbell of FIG. 1.

Selector 12 of this invention has a substantially continuous periphery 24 that substantially encloses an open interior 26. Preferably, as best shown in FIGS. 5 and 7, selector 12 is shaped as a four sided polygon, such as a square or rectangle, having straight sides. Thus, in its preferred form, periphery 24 is formed by a pair of parallel, spaced, left and right side walls **28*l*, 28*r* that are joined together by a pair of parallel, spaced, front and rear walls 30*f*, 30*r*. Consequently, selector 12 is shaped like a four sided picture frame with the area inside the frame comprising the open interior 26 of selector 12. Other shapes could be used for selector 12**, such as other polygonal shapes, e.g. a hexagon or octagon, or even non-polygonal shapes.

If one disregards for the moment the presence of rear wall **30*r* of selector 12, selector 12 then comprises a U-shaped connecting pin that is similar, with some important differences that will be described hereafter, to the traditional connecting pins used in PowerBlock® dumbbells as shown in the '064 and '947 patents that were earlier incorporated by reference herein. Side walls 28 of selector 12 slide into any selected set of slots 20 in handle ends 14 with left side wall 28*l* sliding into one slot 20 in left handle end 14*l* while right side wall 28*r* simultaneously slides into the corresponding slot 20 at the same vertical elevation in right handle end 14*r*. In this regard, side walls 28 function as the connecting prongs of selector 12. When selector 12 is fully inserted in this manner, side walls 28 extend perpendicularly relative to hand grip 16 of handle 10 to be located immediately below the front and back rails 8***f*, 8*r* of one selected weight 4. Thus, when the user reaches down into handle 10 to grip hand grip 16 and thereby lift handle 10, the one selected weight 4 will be lifted upwardly along with all of the weights 4 whose rails 8 lie above the rails 8 of the one selected weight.

In the example shown in FIGS. 1 and 2, selector 12 in its installed position has been slid into the set of slots 20 corresponding to the fifth weight, i.e. slots 20 immediately below the rails of the fifth weight, in the set of the seven nested weights 4. When the user grips hand grip 16 and lifts handle 10, the innermost five weights 4 will be coupled to handle 10 such that the exercise mass of the dumbbell is formed by the combined weight of the innermost five weights 4, the weight of handle 10, and the weight of selector 12. In this example, the two outermost weights 4 will be uncoupled from handle 10 when the user lifts handle 10 and will remain in their nested configuration on a support surface as dumbbell 2 is being used by the user to perform various dumbbell type lifting exercises. Thus, selector 12 of this invention operates substantially identically to selectors 12 previously used in many PowerBlock® dumbbells.

Figure 4:
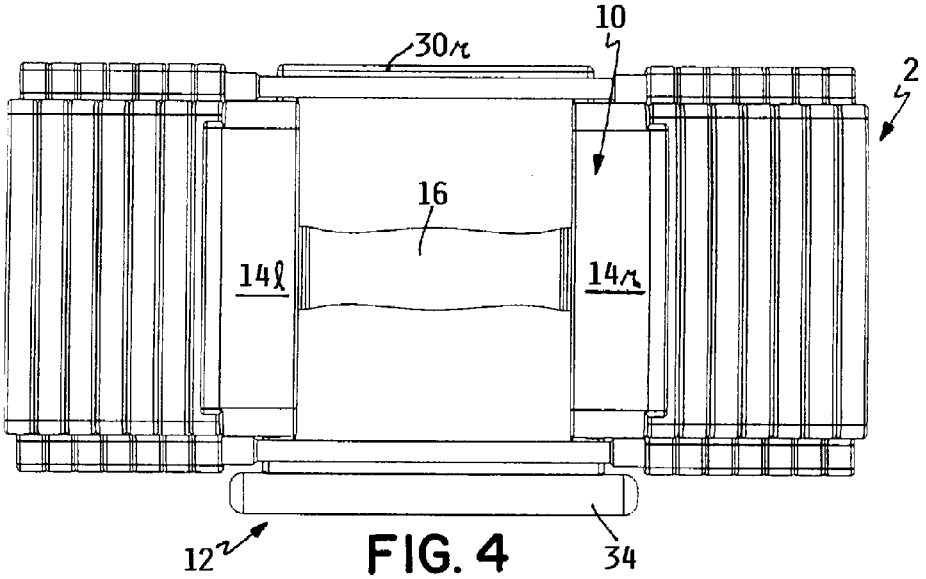
FIG. 4 is a top plan view of the dumbbell of FIG. 1, particularly illustrating the weight selector in an installed position.

Turning now to the differences between selector 12 of this invention and its prior art counterparts, a significant difference is the presence of the fourth wall in selector 12, namely rear wall 30*r*. It is the presence of rear wall 30*r* that provides selector 12 with a substantially continuous periphery 24 that defines open interior 26. When selector 12 is in its installed position as shown in FIG. 4, open interior 26 of selector 12 corresponds substantially to the open area between the front and back rails 8*f*, 8*r* of weights 4 and left and right handle ends 14*l*, 14*r* of handle 10. Thus, selector 12 is out of the way of the open area into which the user inserts his or her hand in order to grip hand grip 16 of handle 10. Accordingly, selector 12 does not present any obstructions to how a user grips hand grip 16 of handle 10 or exercises with dumbbell 2.

Figure 6:
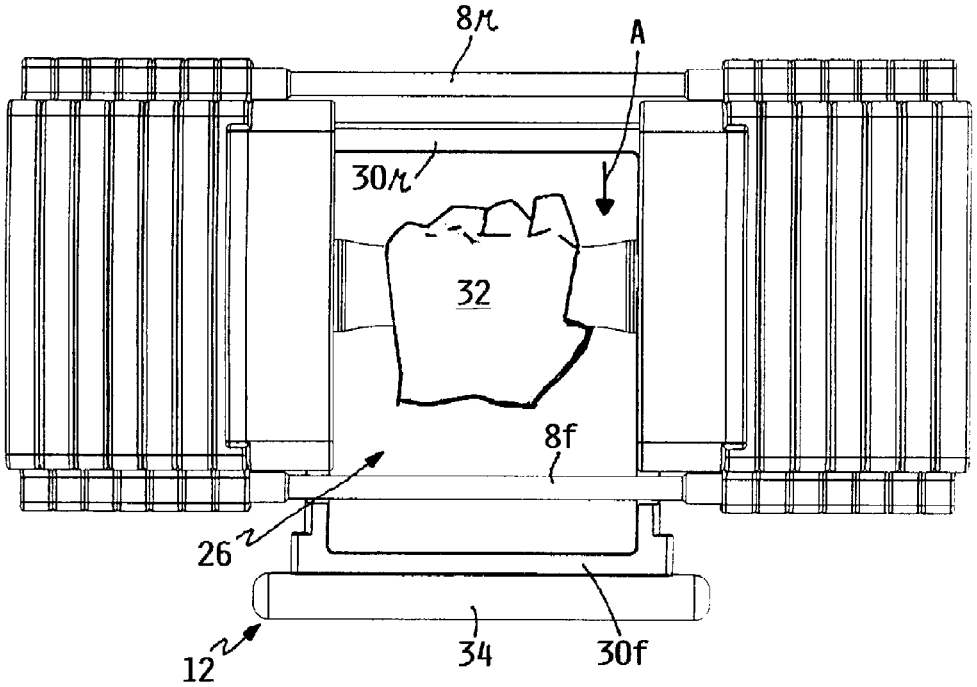
FIG. 6 is a top plan view similar to FIG. 5, particularly illustrating the weight selector in a partially disengaged position with a portion of the weight selector moving towards an interfering contact with the user's hand on the hand grip of the handle to prevent complete disengagement of the weight selector.

Turning now to FIG. 6, if selector 12 should begin to disengage from handle 10 while the user is exercising with dumbbell 2 with selector 12 sliding in the direction of the arrow A partially back out of the selected set of slots in handle ends 14 into which selector 12 had initially been inserted, rear wall 30*r* of selector 12 will now begin to move back through the area between the front and back rails 8*f*, 8*r* of weights 4 and left and right handle ends 14*l*, 14*r* of handle 10. In effect, rear wall 30*r* of selector 12 will move from its fully installed position beneath rear rail 8*r* of the selected weight 4 back towards the front rail 8*f* of the selected weight 4. If rear wall 30*r* were free to move all the way back towards and then past the front rail 8*f*, selector 12 would completely disengage from handle 10 with the result that weights 4 would no longer be coupled to handle 10. If this complete disengagement were to occur during exercise, the release of weights 4 would risk damage to weights 4 or handle 10 or present a risk of potential injury to the user.

However, as shown in FIG. 6, such a complete disengagement is now impossible due to the presence of rear wall 30*r*. As rear wall 30*r* moves back towards front rail 8*f* during an unintentional movement of selector 12 while the user is exercising, rear wall 30*r* will rather quickly contact some portion of whichever hand 32 the user is using to hold hand grip 16 or against the user's wrist or forearm leading to hand 32. Thus, the user will notice that selector 12 is disengaging quite quickly during an unintended dislodgement of selector 12 when the user feels selector 12 hit his or her hand 32, wrist or forearm. The user can thus quickly stop exercising, lower dumbbell 2, and reset selector 12 to its installed position. This will prevent any risk of damage or injury and increases the safety of using dumbbell 2 even for an inexperienced user.

In this regard, the various sets of slots 20 in handle ends 14 are positioned so that rear wall 30*r* of selector 12 will hit some portion of the user's hand 32, wrist or forearm as selector 12 begins to disengage. For slots 20 positioned beneath the centerline of hand grip 16, a selector 12 underlies hand grip 16 so that a disengaging selector will most likely hit against the fingers or knuckles of hand 32. For slots 20 positioned above the centerline of hand grip 16, selector 12 overlies hand grip 16 so that a disengaging selector will hit against the portion of the back of hand 32 lying between the knuckles and the wrist, or against the user's wrist, or potentially even against the lower portion of the user's forearm, all depending upon how the user's arm is oriented relative to handle 10 during a particular exercise and which set of slots 20 receives selector 12. Thus, given the small target area presented by the user's fingers and knuckles compared to the rest of the user's hand 32, wrist and the lower portion of the forearm, it is preferred that hand grip 16 have its centerline positioned below the centerline of handle ends 14. This position of hand grip 16 permits a majority of slots 20, e.g., five of the seven, to be positioned above the centerline of hand grip 16 with a minority of slots 20, e.g., two of the seven, being positioned below the centerline of hand grip 16. See FIGS. 2 and 3. This asymmetrical slot positioning ensures that rear wall 30*r* of selector 12 will bump up against at least the fingers or knuckles of the user's hand 32 even when slots 20 located below the centerline of hand grip 16 receive selector 12.

It is preferred that selector 12 be entirely continuous all the way around the entire periphery 24 of selector 12 to entirely enclose open interior 26 as this provides maximum strength to selector 12. However, a small gap or discontinuity in selector 12 could be provided in periphery 24 of selector 12 as long as selector 12 is still substantially continuous to ensure that the interfering contact with the user's hand 32, wrist or forearm as described above is maintained during unintended dislodgement of selector 12. For example, even a gap or discontinuity of one or two inches in rear wall 30*r* of selector 12 would still leave enough of rear wall 30*r* in place to cause the remaining portion of rear wall 30*r* to move into the required interfering contact during unintended dislodgement. Thus, the terms "substantially continuous" or "substantially encloses" as used in the specification or claims in connection with periphery 24 or open interior 26 of selector 12 are intended to cover a selector which might have a discontinuity as long as the discontinuity is small enough to maintain the interfering contact with the user's hand 32, wrist or forearm should selector 12 unintentionally begin to dislodge.

In addition to the enhanced safety provided by rear wall 30*r* of selector 12, the presence of rear wall 30*r* means that it is impossible for a user to cross-pin selector 12. If a user improperly tilts selector 12 when trying to install it with left side wall 28*l* attempting to enter into a chosen slot 20 in left handle end 14*l* while right side wall 28*r* attempts to enter into a non-corresponding slot 20 in right handle end 14*r* that is either above or below the chosen slot 20 in left handle end 14*l*, rear wall 30*r* of selector 12 will hit against front rail 8*f* of the selected weight 4 to prevent insertion of selector 12. Selector 12 cannot physically be inserted into handle ends 14 in a cross-pinned manner. Accordingly, safety is further enhanced by completely eliminating the danger of cross-pinning.

Referring to FIGS. 4, 5 and 7, front wall 30*f* of selector 12 includes a cylindrical grip member 34 along its outermost face. Grip member 34 is slightly longer than front wall 30*f* and vertically taller than front wall 30*f* to protrude above and below front wall 30*f*. Front wall 30*f* of selector 12 also includes two forwardly extending stops 36 on either side thereof. Stops 36 abut against the front faces of the left and right ends 14*l*, 14*r* of handle 10 when selector 12 is in its fully installed position as shown in FIG. 4 to prevent selector 12 from being pushed in any further. In this fully installed position of selector 12 as determined by stops 36, grip member 34 is offset from the adjacent front rail 8*f* of the selected weight 4 to allow the user to more easily grasp grip member 34 to be able to more easily push grip member 34 inwardly or pull it outwardly relative to handle 10.

In addition to the safety aspect discussed above that arises from the substantially continuous periphery of selector 12, side walls 28 of selector 12 preferably have a flexible central portion 38 extending over the middle one half to the middle three quarters or so of the length of side walls 28. Preferably, selector 12 is integrally molded as one piece out of a plastic material. As best shown in FIG. 7, flexible central portion 38 of each side wall 28 results from a plurality of upwardly and downwardly extending notches 40 that extend through only a portion of the thickness of each side wall 28, thus allowing the segments of side walls 28 between notches 40 to flex relative to one another. Notches 40 allow central portion 38 of each side wall to bend or curve during insertion of selector 12 to develop a frictional retention force relative to handle 10.

Figure 2:
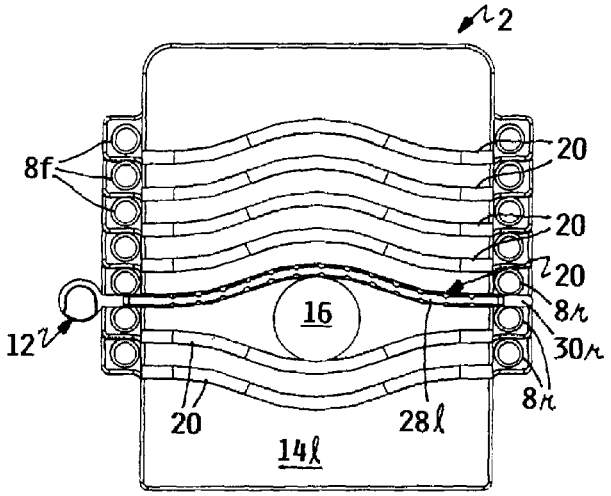
FIG. 2 is a cross-sectional view through the center of the dumbbell of FIG. 1 taken in a plane perpendicular to the axis of elongation of the hand grip of the handle.
Figure 3:
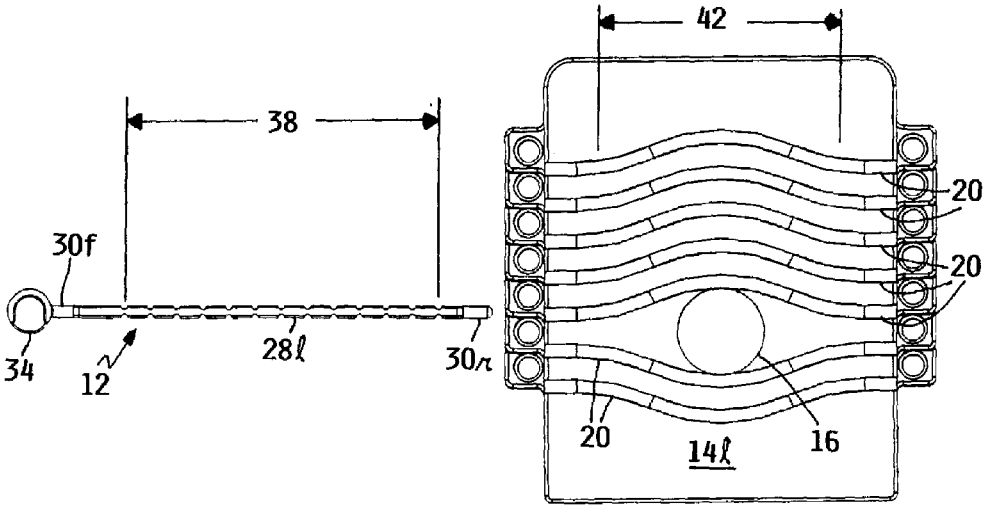
FIG. 3 is a cross-sectional view similar to FIG. 2, particularly illustrating the weight selector in a non-installed position relative to the fifth nested weight of the dumbbell.

As best seen in FIGS. 2 and 3, slots 20 in each end wall include curved central portions 42 whose lengths are substantially equal to the lengths of flexible central portions 38 of side walls 28 of selector 12. The curve in central portions 42 of slots 20 is fairly shallow with the apex of the curve as indicated by the point A in FIG. 3 being elevated above the base of the curve by approximately 10% to 20% of the length of the curve. To prevent any interference with hand grip 16, slots 20 positioned above the centerline of hand grip 16 have their curved central portions 42 facing convexly downwardly while slots 20 positioned below the centerline of hand grip 16 are inverted with their curved central portions 42 facing concavely upwardly.

As best shown in FIG. 3, to insert selector 12 into any selected set of slots 20 in ends 14 of handle 10, selector 12 is aligned with the entrance portion of the selected set of slots 20 that are positioned beneath the front and rear rails 8*f*, 8*r* of a selected weight 4. As shown by way of example in FIG. 3, selector 12 is aligned to pick up the fifth weight 4 and so the selected set of slots 20 is that set that lies immediately beneath the front and rear rails 8*f*, 8*r* of the fifth weight 4. Once selector 12 is so aligned, the user simply pushes inwardly on grip member 34 of selector 12 until the left and right side walls 28*l*, 28*r* of selector 12 are pushed into and travel along the selected set of slots 20 in the left and right ends 14*l*, 14*r* of handle 10. As selector 12 is so pushed, the short length of the beginning and end portions of side walls 28 of selector 12 along with the lengthy flexible central portions 38 of side walls 28 allows selector 12 to pass along the length of slots 20. When fully installed, curved central portions 42 of slots 20 have caused flexible central portions 38 of side walls 28 of selector 12 to assume a curved shape equal to the curve in central portions 42 of slots 20.

The curve that is imparted to flexible central portions 38 of side walls 28 develops a biasing force in the side walls 28 of selector 12 that attempts to return or restore selector 12 to its natural, flat state. Of course, curved central portions 42 of slots 20 prevent this from happening. But, the biasing force created in flexible central portions 38 of side walls 28 of selector 12 act against the slots 20 in which they are received to frictionally retain selector 12 in place. This biasing force creates a redundant mechanism tending to hold selector 12 in its installed position. Not only does the fourth or rear wall 30*r* of selector 12 act as one mechanism in preventing unintended dislodgement of selector 12, but the biasing force created in side walls 28 of selector 12 caused by the curve imparted to side walls 28 of selector 12 in its fully inserted position acts as an additional retention mechanism.

The two selector retention mechanisms as described above can be simultaneously used in selector 12 together as shown and described herein. However, either mechanism could be used separately in selector 12 without using the other. For example, selector 12 could be made as a rigid member without any flexible central portions 38 in side walls 28 thereof. In this variation, slots 20 in the left and right ends 14*l*, 14*r* of handle 10 would then be purely horizontal to receive the flat and now rigid side walls 28 of selector 12. While such an alternative would not possess the retention mechanism provided by the biasing force developed in flexible central portions 38 of side walls 28, it would still incorporate the retention mechanism of using a selector 12 with the substantially continuous periphery 24 surrounding the open interior 26. Alternatively, the retention mechanism provided by the biasing force developed in flexible central portions 38 of side walls 28 when those portions become curved due to the presence of curved central portions 42 of slots 20 could be used in a selector 12 that has only three sides, such as the U-shape of the traditional PowerBlock® selector, or even in separate single pin type selectors in which two separate pins are used to separately couple the left and right ends 14*l*, 14*r* of handle 10 to the selected weights 4.

Other modifications of this invention will be apparent to those skilled in the art. Accordingly, the scope of this invention is not to be limited to the details of the various embodiments of this invention as described herein, but shall be limited only by the appended claims.

The invention claimed is:

1. A selectorized dumbbell, which comprises:

(a) a plurality of nested weights that provide a stack of left weight plates and a stack of right weight plates;

(b) a handle located between the weight plate stacks;

(c) a selector that is insertable into a selected one of a plurality of vertically spaced positions on the handle to couple a selected number of the weights to the handle, wherein the selector has a substantially continuous periphery that substantially encloses an open interior; and (d) wherein, during unintended dislodgement of the selector during exercise activities using the dumbbell, a portion of the selector's periphery contacts a portion of a user's hand, wrist or forearm on an arm the user is using to grip the handle to stop further dislodgement of the selector.

2. The dumbbell of claim 1, wherein side walls of the selector become curved when the selector is installed to provide a frictional force further resisting dislodgement of the selector.

3. A selectorized dumbbell, which comprises:

(a) a plurality of individual weights that can be nested together to provide a left stack of nested left weight plates and a right stack of nested right weight plates that are separated by a gap;

(b) a handle having a hand grip extending along an axis with the handle further having opposite left and right ends joined to opposite ends of the hand grip with the left and right ends of the handle extending perpendicularly to the hand grip, wherein the handle may be dropped down into the gap between the stacks of nested left and right weight plates with the left end of the handle being adjacent an innermost left weight plate in the left stack of weight plates and the right end of the handle being adjacent an innermost right weight plate in the right stack of weight plates; and (c) a selector having a substantially continuous periphery that substantially encloses an open interior of the selector, wherein the selector is horizontally insertable into the ends of the handle into a selected one of a plurality of different vertical positions on the handle to connect a desired number of weights to the handle depending upon which vertical position receives the selector, and wherein the open interior of the selector when the selector is installed overlies or underlies the hand grip of the handle.

4. The dumbbell of claim 3, wherein the hand grip permits a user to grip the hand grip with one hand to perform exercises with the dumbbell, and wherein a portion of the periphery of the selector contacts against a portion of the one hand of the user or against a wrist or forearm connected to the one hand during unintended dislodgement of the selector during exercise by the user with the dumbbell.

5. The dumbbell of claim 3, wherein the selector comprises a four sided plane figure having a pair of spaced left and right side walls joined together by a pair of spaced front and back walls.

6. The dumbbell of claim 5, wherein the left and right side walls and the front and back walls are straight sided with the left and right side walls being parallel to one another and the front and back walls being parallel to one another such that the plane figure comprises a square or rectangle.

7. The dumbbell of claim 5, wherein identical arrays of vertically spaced slots are provided on the left and right ends of the handle with each slot in the left end of the handle having a corresponding slot at an identical elevation in the right end of the handle so that a plurality of corresponding sets of slots at different vertical elevations are provided by the arrays of slots with the sets of slots defining the plurality of different vertical positions on the handle into which the selector may be inserted, and wherein the left and right side walls of the selector slide into and are received within one selected set of slots in the left and right ends of the handle when the selector is installed in the handle.

8. The dumbbell of claim 7, wherein the left and right side walls of the selector each have a flexible central portion, and wherein the slots in the corresponding sets of slots have curved central portions that cause the flexible central portions of the side walls to become curved during insertion of the selector into the one selected set of slots.

9. The dumbbell of claim 8, wherein the selector is made of a material such that the disposition of the flexible central portions of the left and right side walls of the selector when the selector is installed in the one selected set of slots creates a biasing force which attempts to return the left and right side walls of the selector back to a natural, flat state thereof, and wherein the biasing force is sufficient to further frictionally retain the selector within the one selected set of slots.

10. A selectorized dumbbell, which comprises:

(a) a plurality of individual weights that can be nested together to provide a stack of nested left weight plates and a stack of nested right weight plates that are separated by a gap;

(b) a handle that may be dropped down into the gap between the stacks of nested left and right weight plates;

(c) a selector that connects a desired number of weights to the handle, wherein the selector comprises at least one elongated connecting member that is insertable into a selected one of a plurality of vertically spaced slots provided on the handle with the number of weights coupled to the handle varying depending upon which slot receives the connecting member, wherein the at least one connecting member has a natural, flat state when it is not installed in the selected slot, wherein each of the slots has a curved central portion therein, wherein the at least one connecting member includes a flexible central portion that becomes curved by virtue of being received in the curved central portion of the selected slot when the at least one connecting member is installed in the selected slot, and wherein the curved flexible central portion of the at least one connecting member develops a biasing force that attempts to restore the at least one connecting member to the natural, flat state thereof with the biasing force serving to frictionally resist disconnection of the at least one connecting member from the selected slot.

* * * * *